US007886678B2

(12) United States Patent
Mizutani

(10) Patent No.: US 7,886,678 B2
(45) Date of Patent: Feb. 15, 2011

(54) WATERCRAFT

(75) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 90 days.

(21) Appl. No.: 12/203,942

(22) Filed: Sep. 4, 2008

(65) Prior Publication Data

US 2009/0075533 A1 Mar. 19, 2009

(30) Foreign Application Priority Data

Sep. 18, 2007 (JP) ..... 2007-240816

(51) Int. Cl.

| | |
|---|---|
| ***B63H 25/00*** | (2006.01) |
| ***G05D 1/02*** | (2006.01) |
| *B63H 5/125* | (2006.01) |
| *B63H 20/08* | (2006.01) |

(52) U.S. Cl. ..... 114/144 RE; 440/61 G

(58) Field of Classification Search ..... 440/6, 440/53, 61 S, 61 G; 320/104; 114/144 RE
See application file for complete search history.

(56) References Cited

U.S. PATENT DOCUMENTS 6,525,508 B1 * 2/2003 Kanno ..... 320/104

* cited by examiner

*Primary Examiner*—Daniel V Venne
(74) *Attorney, Agent, or Firm*—Keating & Bennett, LLP

(57) ABSTRACT

A watercraft includes a plurality of outboard motors. Each of the outboard motors has a generator and a rudder deflecting system driven by an electric motor. The outboard motors are turned by the rudder deflecting systems thereby steering the watercraft. Electric power can be supplied from the generators of others of the plurality of outboard motors to the rudder deflecting system of an arbitrary outboard motor among the plurality of the outboard motors. Using this arrangement it is possible to provide a watercraft in which electric power for operation is stably supplied to the rudder deflecting system without increasing the size of the generators.

6 Claims, 13 Drawing Sheets

WATERCRAFT

BACKGROUND OF THE INVENTION

1. Field of the Invention

The present invention relates to a watercraft having a plurality of watercraft propulsion units, a generator disposed in each of the watercraft propulsion units, and a rudder deflecting system disposed in each of the watercraft propulsion units. The watercraft propulsion units are turned by the rudder deflecting systems thereby steering the watercraft.

2. Description of the Related Art

Conventionally, there are watercrafts of the kind described above, as shown in FIGS. 10, 11A, and 11B. The watercraft has a plurality of, herein two, outboard motors 1 as watercraft propulsion units. A generator 2 and a main battery 3 are connected to each of the outboard motors 1. The outboard motors 1 are steered by rudder deflecting systems 4.

That is, when an operator of the watercraft rotates a steering wheel (not shown), a rotational angle of the steering wheel is detected, and the signal is sent to the rudder deflecting system 4 of the outboard motor 1. An electric motor of the rudder deflecting system 4 is driven with electric power from the generator 2, the main battery 3, and the like, and the outboard motor 1 is steered.

On the other hand, when electric power from the main battery 3 is supplied to a starter motor of an engine of each of the outboard motors 1 and the engine is started, the generator 2 generates electric power from the drive of the engine. The main battery 3 is charged, and electric power is supplied to the rudder deflecting system 4.

The generator 2 also supplies electric power to a PTT (power trim and tilt system), an auxiliary device, and the like.

Further, a sub-battery (accessory battery) 5 is connected to the two generators 2. The sub-battery 5 supplies electric power to accessory devices such as an engine speed sensor, fishfinder, GPS, etc. (not shown). JP-A-2001-128388 discloses a watercraft of this kind.

However, in this kind of conventional watercraft, the generator 2 generates electric power for each of the outboard motors 1, and this electric power is supplied only to the rudder deflecting system 4 and the like of the individual outboard motor 1.

That is, a steering force acts on the outboard motor 1 because of a propeller reaction force, and thus the outboard motor 1 constantly requires steering. A steering load to one of the outboard motors 1 (for example, the outboard motor 1 on the starboard side) is larger than a steering load to the other outboard motor 1 (for example, the outboard motor 1 on the port side) in the case that the watercraft having a plurality of outboard motors 1 is turning, for example.

As a result, as shown in FIG. 11A, the main battery 3 of the outboard motor 1 on the port side is charged since consumption of electric power is smaller than an amount of generated electric power on that side. However, the main battery 3 of the outboard motor on the starboard side discharges electric power since consumption of electric power is larger than an amount of generated electric power on that side.

Therefore, the main battery 3 of the starboard side outboard motor 1 tends to be insufficiently charged, which causes the rudder deflecting system 4 to have an insufficient output.

To cope with this circumstance, the generator 2 may be arranged to supply the maximum electric power required by the outboard motor 1. However, this results in increases in both the size of the generator 2 and the cost.

SUMMARY OF THE INVENTION

In order to overcome the problems described above, preferred embodiments of the present invention provide a watercraft in which operational electric power is stably and reliably supplied to the rudder deflecting system without increasing a size of a generator.

A first preferred embodiment of the present invention provides a watercraft having a plurality of watercraft propulsion units. Each of the watercraft propulsion units has a generator and a rudder deflecting system arranged therein. Each of the watercraft propulsion unit includes an electric motor for supplying a driving force. The watercraft propulsion units are turned by operation of the rudder deflecting systems, and the watercraft is steered thereby. Additionally, electric power can be supplied from the generators of the other watercraft propulsion units to the rudder deflecting system of any other watercraft propulsion unit among the plurality of the watercraft propulsion units.

A second preferred embodiment of the present invention provides a watercraft in which a main battery preferably is provided for each of the plurality of the watercraft propulsion units while being connected thereto. The main battery is capable of supplying electric power to the rudder deflecting system of the watercraft propulsion unit and to not supply electric power to the rudder deflecting systems of the other watercraft propulsion units.

A third preferred embodiment of the present invention provides a watercraft in which a main battery is provided for each of the plurality of the watercraft propulsion units while being connected thereto, and electric power is supplied from the generators of the other watercraft propulsion units to the main battery of an arbitrary watercraft propulsion unit.

A fourth preferred embodiment of the present invention provides a watercraft in which a sub-battery is connected to the plurality of watercraft propulsion units, and electric power is supplied from the sub-battery to each of the main batteries.

A fifth preferred embodiment of the present invention provides a watercraft in which a plurality of generators are provided for each of the watercraft propulsion units, an arbitrary generator among the plurality of generators is connected to the main battery, and the other generators are connected to rudder deflecting systems of the other watercraft propulsion units.

In the first preferred embodiment of the present invention, electric power can be supplied from the generators of the other watercraft propulsion units to the rudder deflecting system of an arbitrary watercraft propulsion unit among the plurality of the watercraft propulsion units. Therefore, electric power can be stably and reliably supplied to the rudder deflecting systems without increasing a size of the generator.

In the second preferred embodiment of the present invention, the watercraft is constructed such that the main battery is provided for each of the plurality of the watercraft propulsion units while being connected thereto. The main battery is capable of supplying electric power to the rudder deflecting system of the watercraft propulsion unit and to not supply electric power to the rudder deflecting systems of the other watercraft propulsion units. Accordingly, a reduction in the amount of electric power used for charging the main battery can be prevented since the generator does not supply electric power to the rudder deflecting systems of the other watercraft propulsion units.

In the third preferred embodiment of the present invention, electric power is supplied from the generators of the other watercraft propulsion units to the main battery of an arbitrary watercraft propulsion unit. Therefore, the amount of electric power required for charging the main battery can be assured.

In the fourth preferred embodiment of the present invention, the watercraft is constructed such that electric power is supplied from the sub-battery to each of the main batteries. Therefore, the amount of electric power required for charging each of the main batteries can be ensured.

In the fifth preferred embodiment of the present invention, the plurality of generators are provided for each of the watercraft propulsion units, an arbitrary generator among the plurality of generators is connected to the main battery, and the other generators are connected to the rudder deflecting systems of the other watercraft propulsion units. Accordingly, the amount of electric power required for charging the main battery can be ensured, and electric power can be appropriately supplied to the rudder deflecting systems of the other watercraft propulsion units.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 6A is a graph indicating an amount of generated electric power and a consumption of electric power in the outboard motors on a port side and a starboard side, and FIG. 6B is a graph indicating amounts of electric power for charging a main battery and electric power discharged from a main battery.

FIGS. 11A and 11B are explanatory diagrams explaining the conventional art, wherein FIG. 11A is a graph indicating an amount of generated electric power and a consumption of electric power in outboard motors on a port side and a starboard side, and FIG. 11B is a graph indicating amounts of electric power for charging a main battery and electric power discharged from a main battery.

DETAILED DESCRIPTION OF PREFERRED EMBODIMENTS

Preferred embodiments of the present invention will now be described with reference to the figures.

First Preferred Embodiment

FIGS. 1 through 6 show a first preferred embodiment of the present invention.

Figure 1:
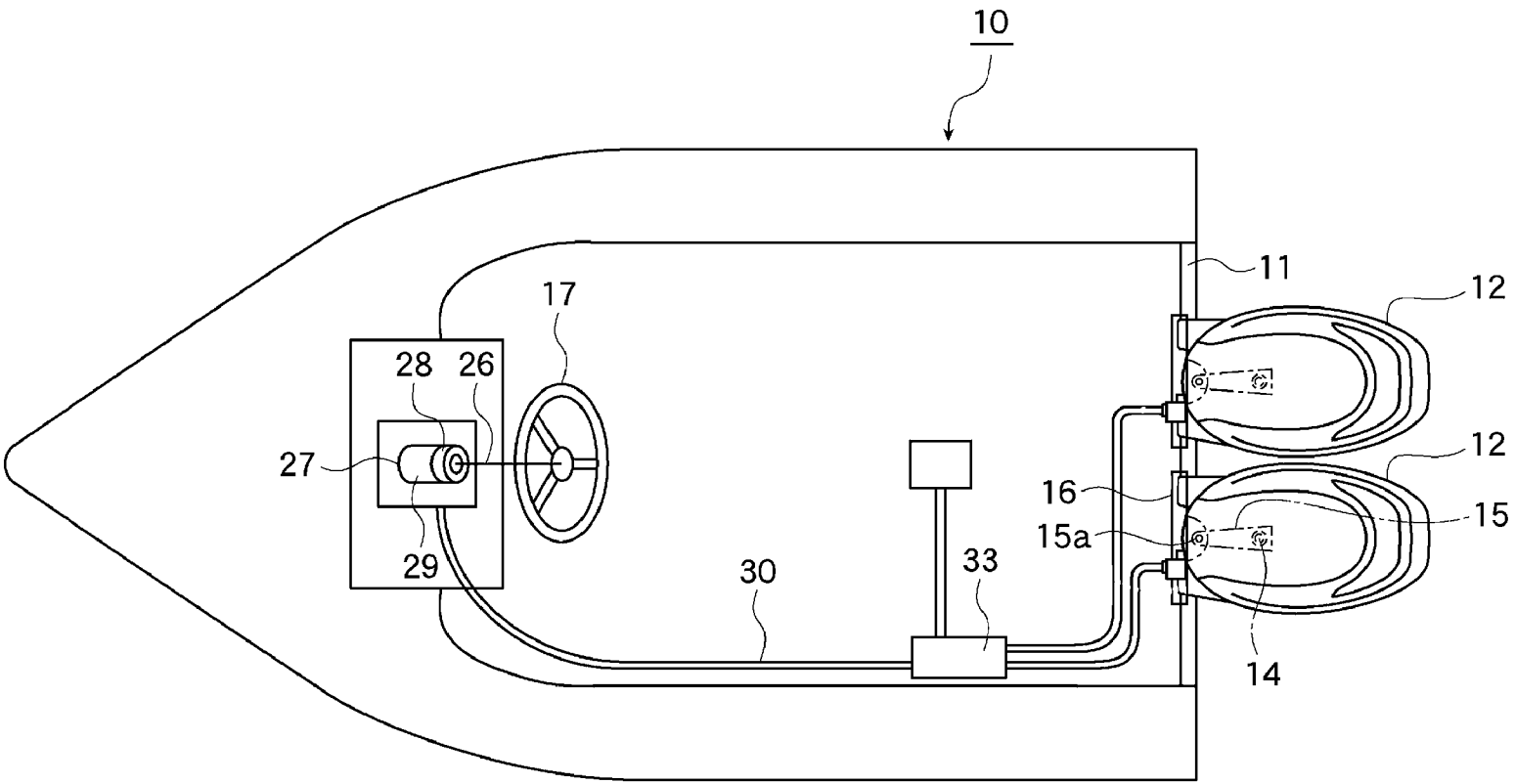
FIG. 1 is a plan view of a watercraft in accordance with a first preferred embodiment of the present invention.

An overall construction of the watercraft will be described first. As shown in FIG. 1, a watercraft in accordance with the first preferred embodiment preferably has two outboard motors 12 as examples of watercraft propulsion units mounted on a stern board 11 of a hull 10. The outboard motors 12 can be turned around swivel shafts 14 provided along the vertical direction.

A steering bracket 15 is fixed to an upper end of the swivel shaft 14. A rudder deflecting system 16 is coupled to a front end 15*a* of the steering bracket 15. The rudder deflecting system 16 is moved by operation of a steering wheel 17 disposed in a cockpit.

Figure 2:
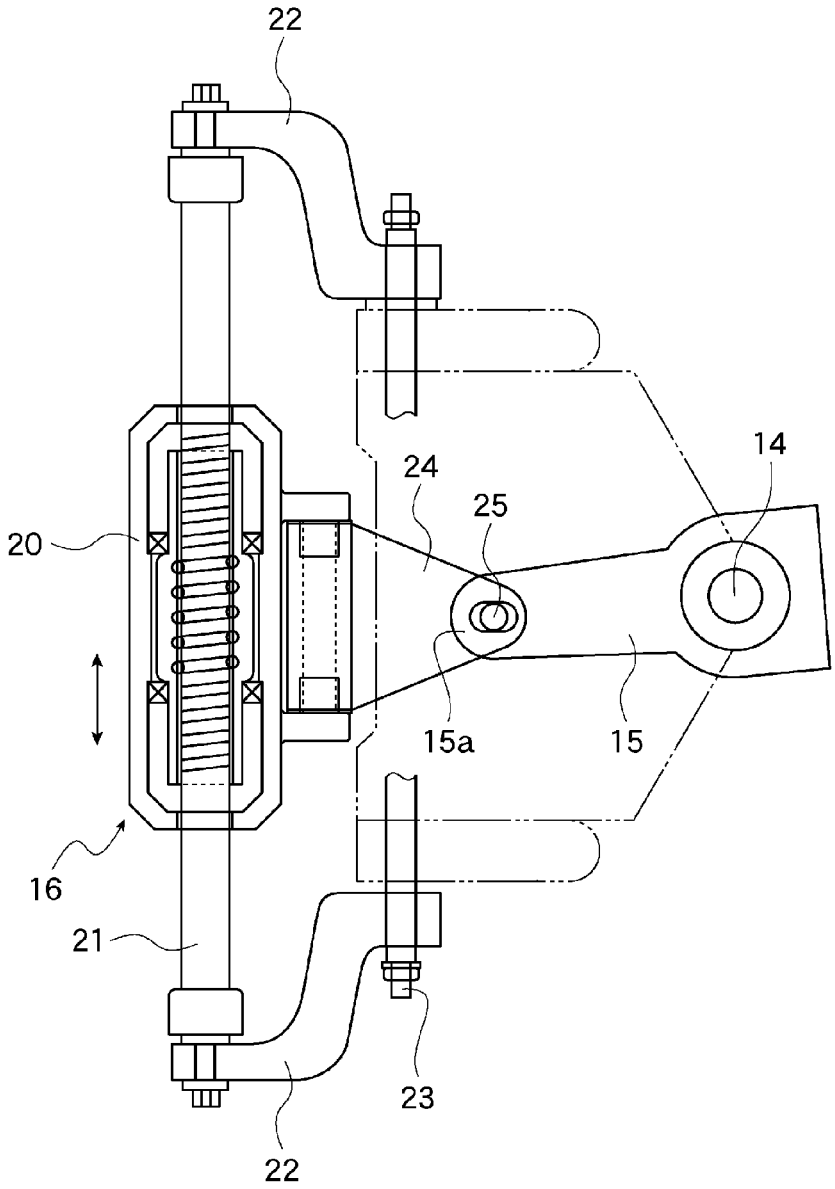
FIG. 2 is a plan view showing a rudder deflecting system and the like in accordance with the first preferred embodiment of the present invention.

As shown in FIG. 2, the rudder deflecting system 16 has an electric motor 20, for example, of a DD (Direct Drive) type. The electric motor 20 is placed on a threaded rod 21 arranged in the right-and-left direction, and moves to right or left along the threaded rod 21.

Both ends of the threaded rod 21 are supported by a pair of right and left supporting members 22. The supporting members 22 are supported by a tilt shaft 23.

A coupling bracket 24 is arranged to protrude rearward from the electric motor 20. The coupling bracket 24 and the steering bracket 15 are coupled together via a coupling pin 25.

Accordingly, as the electric motor 20 drives it moves to right or left along the threaded rod 21. Thereby, the outboard motor 12 rotates around the swivel shaft 14 via the coupling bracket 24 and the steering bracket 15.

On the other hand, as shown in FIG. 1, the steering wheel 17 is fixed to a steering wheel shaft 26. A steering wheel control unit 27 is provided at a base end of the steering wheel 26. The steering wheel control unit 27 has a steering wheel angle sensor 28 for detecting a steering angle of the steering wheel 17, and a reaction motor 29 for applying a desired reaction force to the steering wheel 17 when the steering wheel 17 is operated.

The steering wheel control unit 27 is connected to an ECU (Electronic Control Unit) 33 via a signal cable 30. The ECU 33 is connected to the electric motors 20 of the rudder deflecting systems 16. A signal from the steering wheel angle sensor 28 is input to the ECU 33. The ECU 33 controls and operates the electric motors 20. The ECU 33 also controls the reaction motor 29. A position where the ECU 33 is located is not limited to the position shown in FIG. 1, but the ECU 33 may be located in the outboard motor 12, in a remote controller (not shown) of the watercraft, or the like.

Figure 3:
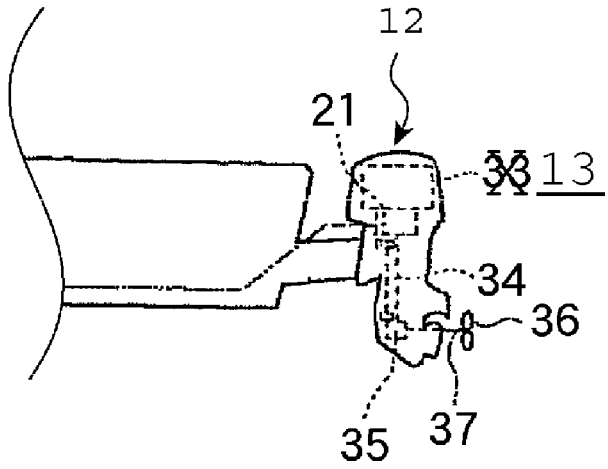
FIG. 3 is a side view of a rear portion of the watercraft in accordance with the first preferred embodiment of the present invention.

Meanwhile, as shown in FIG. 3, the outboard motor 12 has an engine 13 in an upper portion thereof. Output of the engine 13 is transmitted to the propeller shaft 37 to which a propeller 36 is fixed via a drive shaft 34 and the shift device 35.

Figure 4:
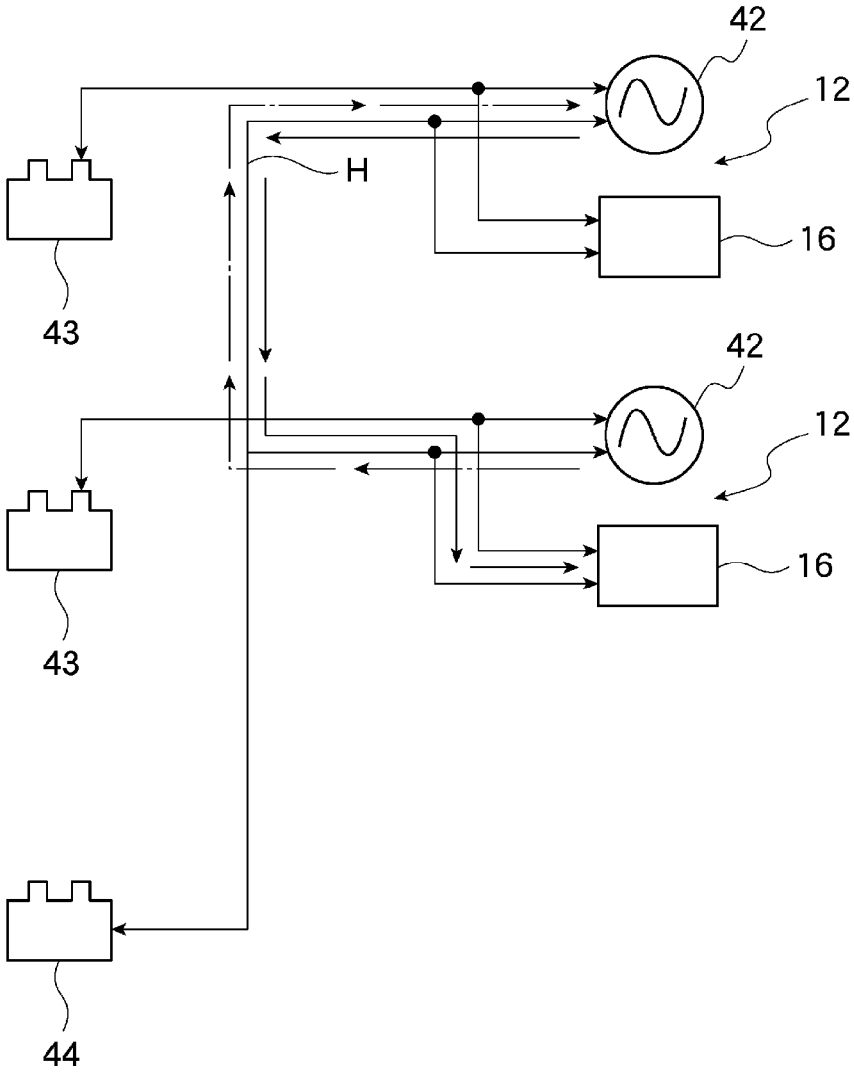
FIG. 4 is a block diagram of various devices for supplying electric power to the rudder deflecting systems in accordance with the first preferred embodiment of the present invention.

As shown in FIG. 4, a generator 42 is provided for each of the engines 13 of the two outboard motors 12. Two main batteries 43 are connected to the generators 42 and the electric motors 20 of the rudder deflecting systems 16.

Further, a sub-battery (for example, a battery for accessory devices) 44 is connected to the generators 42 and the main batteries 43 corresponding to the respective outboard motors 12.

The rudder deflecting system 16 of one of the outboard motors 12 can be supplied with electric power from the generator 42 of the other outboard motor 12 via a connection wiring H between the batteries 44 and the like.

The electric motors 20 of the rudder deflecting devices 16 are operated with electric power from the generators 42, the main batteries 43, and the like, and thereby the outboard motors 12 are steered.

Next, an operation of the first preferred embodiment will be described.

When the steering wheel 17 is rotated in order to steer the hull 10 while the watercraft is traveling, a rotational amount is detected by the steering wheel angle sensor 28, and sent to the ECU 33. The electric motors 20 of the rudder deflecting systems 16 are operated by prescribed amounts in accordance with a signal from the ECU 33. The two outboard motors 12 are turned around the swivel shafts 14 by the prescribed amount in prescribed directions via the steering brackets 15 and the like.

Figure 5:
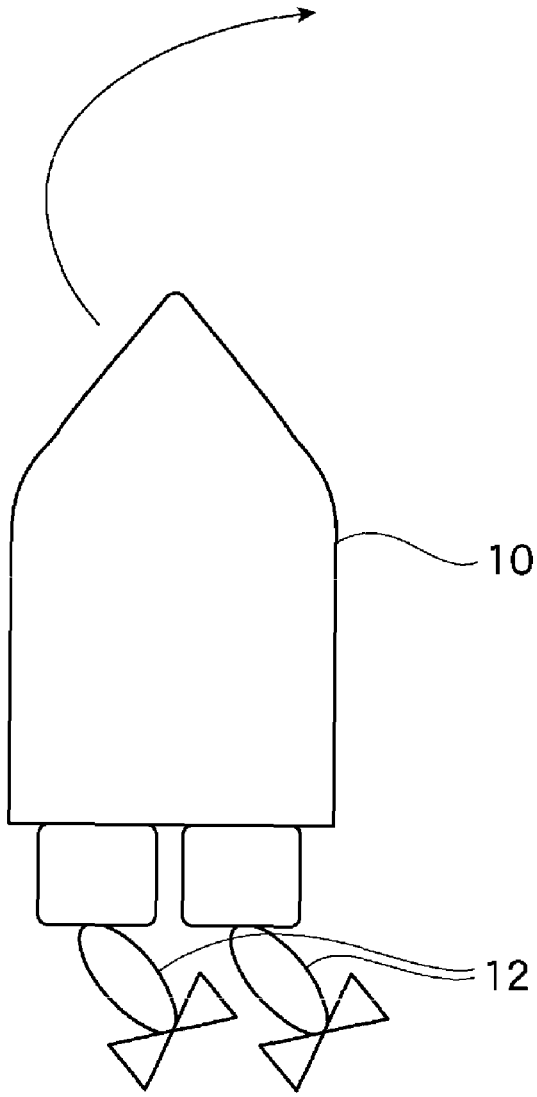
FIG. 5 is an explanatory plan view showing a turning state of the watercraft in accordance with the first preferred embodiment of the present invention.

For example, as shown in FIG. 5, a steering load to one of the outboard motors 12 (the outboard motor 12 on the starboard side in this case) becomes larger than a steering load to the other outboard motor 12 (the outboard motor 12 on the port side in this case) when the two outboard motors 12 are turned and the hull 10 is turned to the right.

Figure 6A:
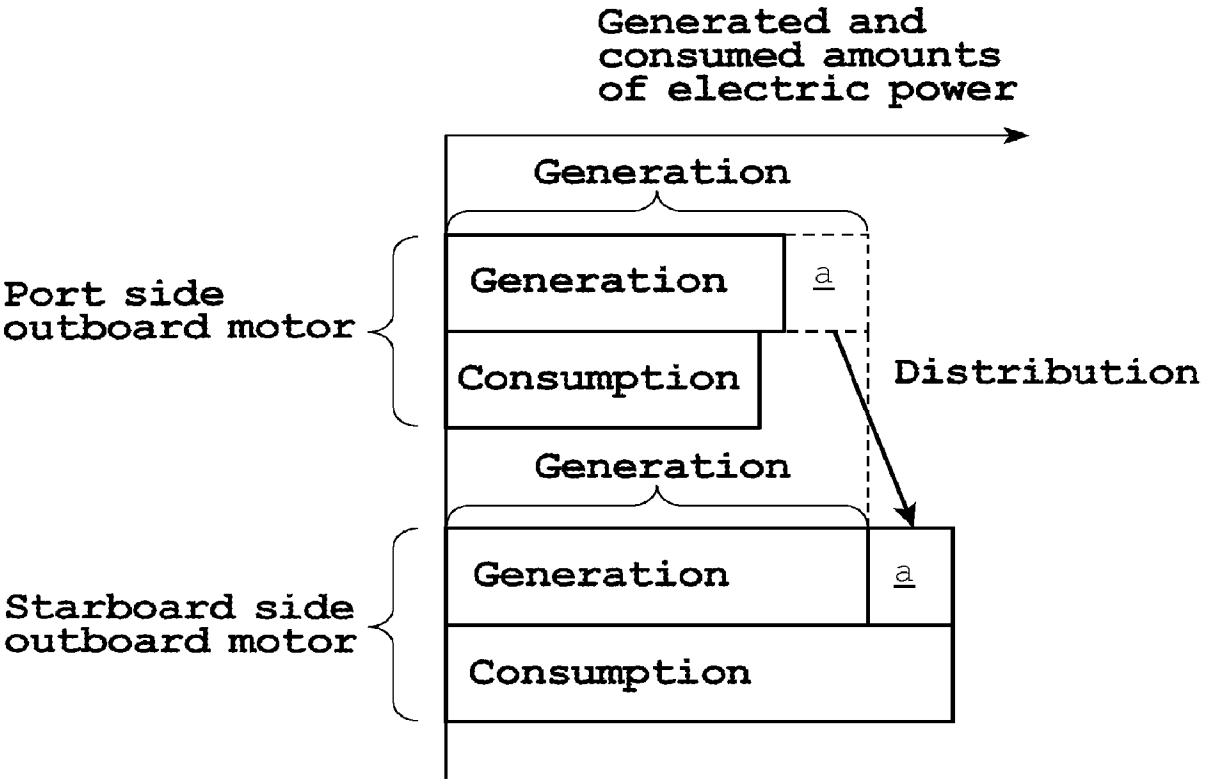
FIGS. 6A and 6B are explanatory diagrams for explaining the first preferred embodiment.

As a result of the example shown in FIG. 6A, the consumption of electric power of the outboard motor 12 on the starboard side is larger than the amount of electric power generated by the generator 42 on the starboard side. The consumption of electric power of the outboard motor 12 on the port side is smaller than the amount of electric power generated by the generator 42 on the port side. The amount of electric power generated by the generator 42 on the starboard side is generally equal to the amount of electric power generated by the generator 42 on the port side. Therefore, a portion (a) of the amount of electric power generated by the generator 42 on the port side is distributed to be added to the amount of electric power generated by the generator 42 on the starboard side via the connection wiring H.

Figure 6B:
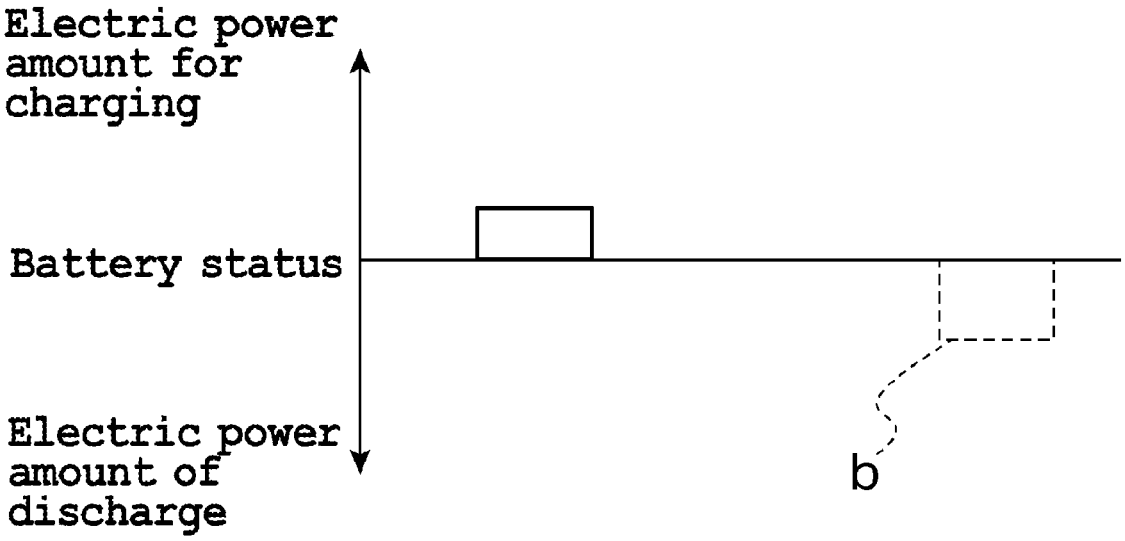

Thereby, the consumption of electric power becomes equal to the amount of generated electric power on the starboard side. Accordingly, discharge "b" as shown by a broken line in FIG. 6B is prevented, and an insufficient charge to the main battery 43 and an insufficient output of the rudder deflecting system 16 are prevented. In the case where the watercraft turns left and the consumption of electric power becomes larger than the generated electric power in the outboard motor 12 on the port side, the amount of electric power generated by the generator 42 on the starboard side is distributed to be added to the amount of electric power generated by the generator 42 on the port side.

Thereby, electric power for operating the rudder deflecting systems 16 can be stably supplied without increasing a size of the generator 42 in the case that a plurality of outboard motors 12 are provided.

Second Preferred Embodiment

Figure 7:
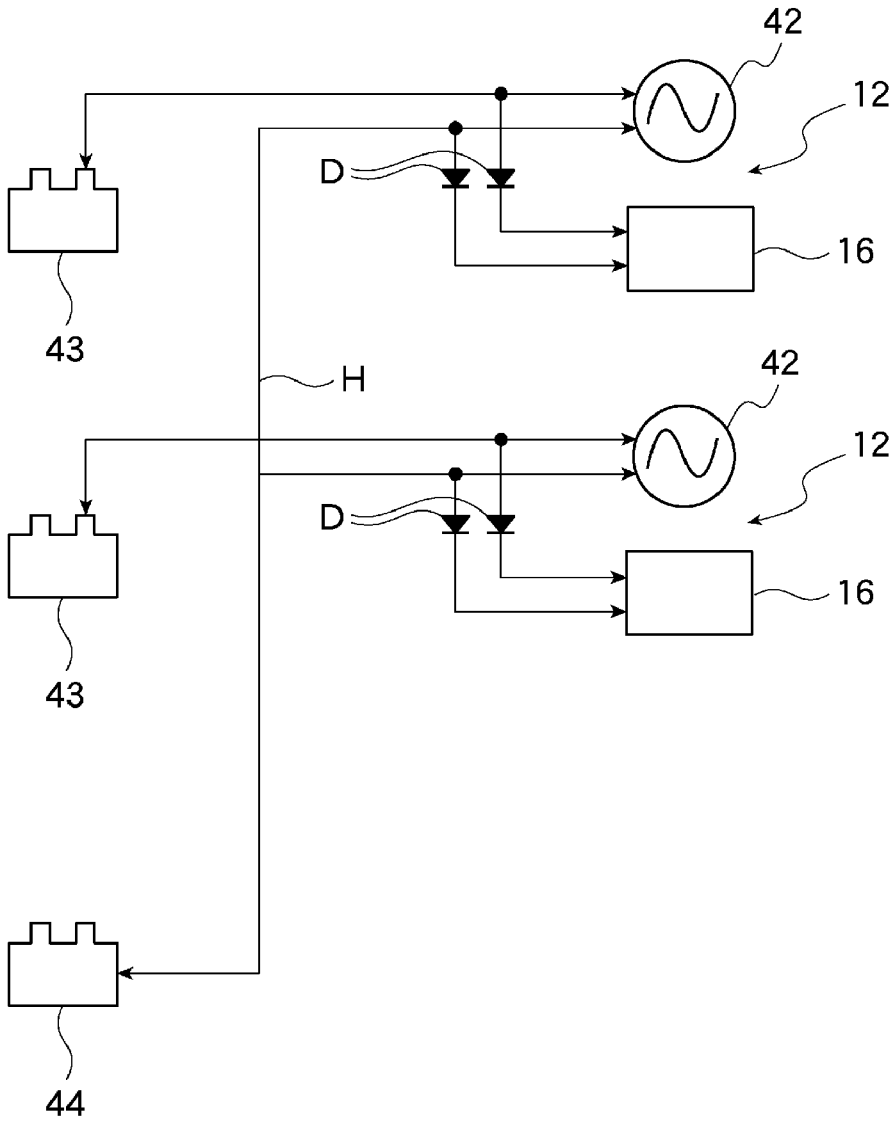
FIG. 7 is a block diagram of various devices for supplying electric power to the rudder deflecting systems in accordance with a second preferred embodiment of the present invention.

FIG. 7 shows a second preferred embodiment of the present invention.

In the second preferred embodiment, diodes D preferably are disposed about midway in the connection wiring H by which the main batteries 43 and the sub-battery 44 are connected to the rudder deflecting systems 16. Thereby, the diodes D intercept electric current running from the rudder deflecting systems 16 toward the main batteries 43 and the sub-battery 44.

In other words, the main battery 43 arranged to start the engine of the outboard motor 12 is connected to each of the plurality of the outboard motors 12. The main battery 43 is connected to the rudder deflecting system 16 of the outboard motor 12 while being capable of supplying electric power to the rudder deflecting system 16, and this main battery 43 does not supply electric power to the rudder deflecting system 16 of the other outboard motor 12.

Accordingly, the main batteries 43 are independent of each other, but electric power may be supplied from the generator 42 of one of the outboard motors 12 to the rudder deflecting system 16 of the other outboard motor 12.

A reduction in the amount of electric power for charging the main battery 43 arranged to start the engine can be prevented by making the main battery 43 of one of the outboard motors 12 independent of the other outboard motor 12 as described above.

Other constructions and actions are similar to the first preferred embodiment, and descriptions thereof are omitted.

Third Preferred Embodiment

Figure 8:
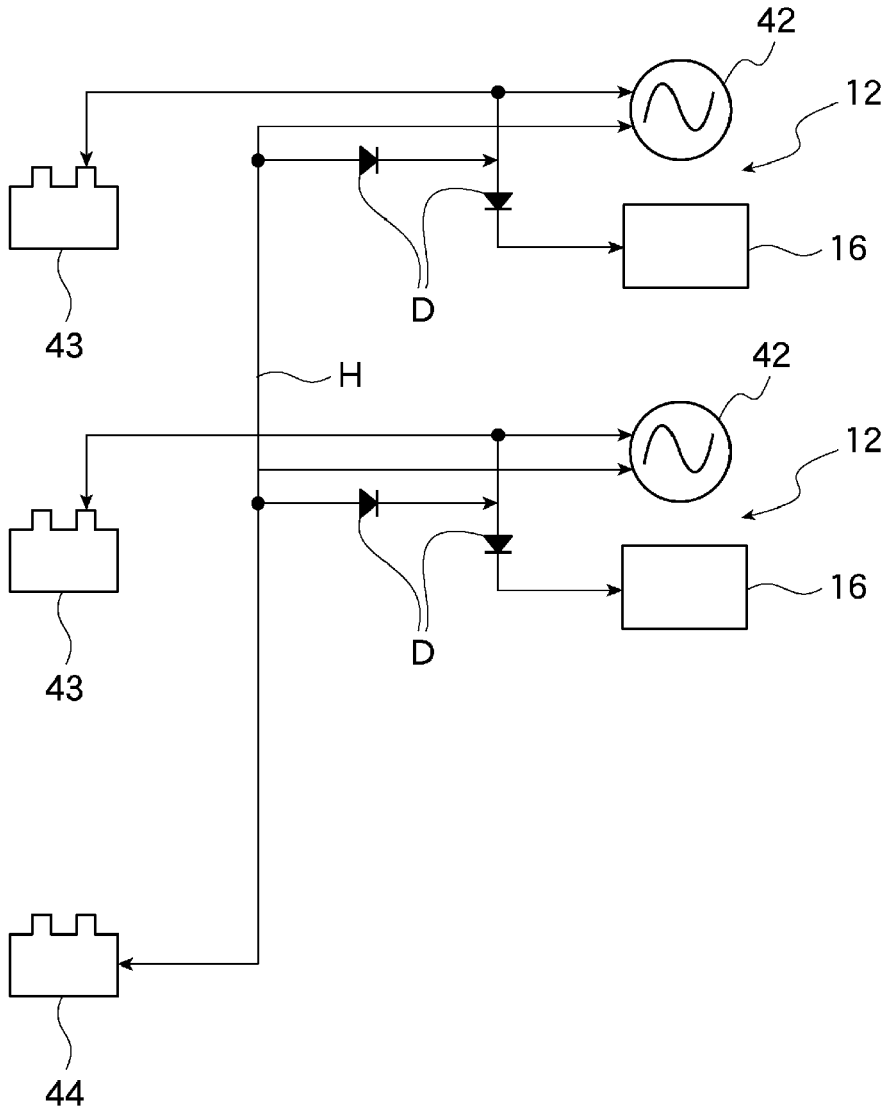
FIG. 8 is a block diagram of various devices for supplying electric power to the rudder deflecting systems in accordance with a third preferred embodiment of the present invention.

FIG. 8 shows a third preferred embodiment of the present invention.

Comparing the third preferred embodiment with the second preferred embodiment, in the second preferred embodiment the sub-battery 44 preferably is directly connected to the rudder deflecting systems 16 via the diodes D. However, in the third preferred embodiment the sub-battery 44 preferably is connected to the positions between the diodes D and the main batteries 43 via other diodes D.

Thereby, electric power is supplied from the generator 42 of an arbitrary outboard motor 12 to the main battery 43 and the rudder deflecting system 16 of the outboard motor 12. Further, electric power is supplied from the generator 42 of the arbitrary outboard motor 12 to the main battery 43 and the rudder deflecting system 16 of the other outboard motor 12.

Electric power is supplied also from the sub-battery 44 to the rudder deflecting system 16 and the main battery 43 of each of the outboard motors 12.

In such a construction, the main battery 43 is charged by electric power supplied from the generator 42 of the other outboard motor 12 via the diode D, and both the main batteries 43 are charged by electric power supplied from the sub-battery 44 via the respective diodes D. No electric power is supplied from the main battery 43 to the other outboard motor 12, and the amount of electric power for charging the main battery 43 can be secured.

Other constructions and actions are similar to the second preferred embodiment, and descriptions thereof are omitted.

Fourth Preferred Embodiment

Figure 9:
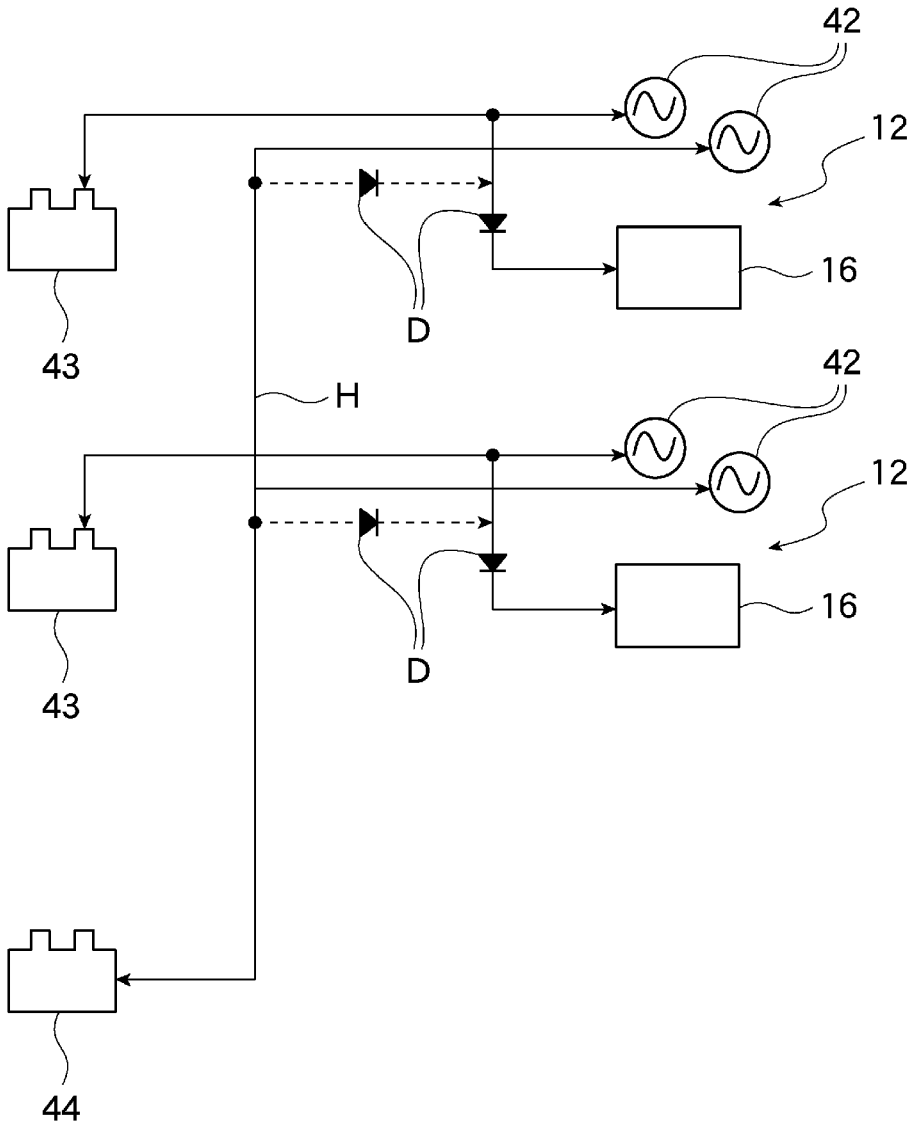
FIG. 9 is a block diagram of various devices for supplying electric power to the rudder deflecting systems in accordance with a fourth preferred embodiment of the present invention.
Figure 10:
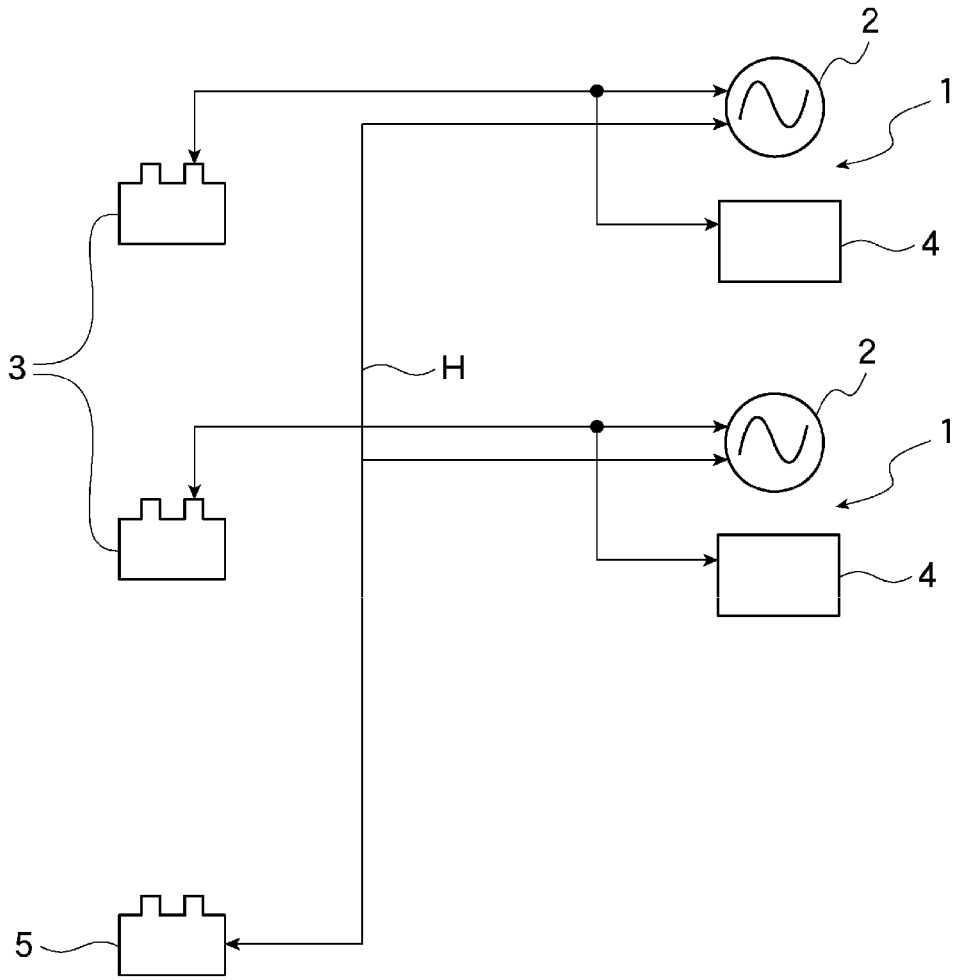
FIG. 10 PRIOR ART
FIG. 10 is a block diagram of various devices for supplying electric power to rudder deflecting systems in the conventional art.
Figure 11A:
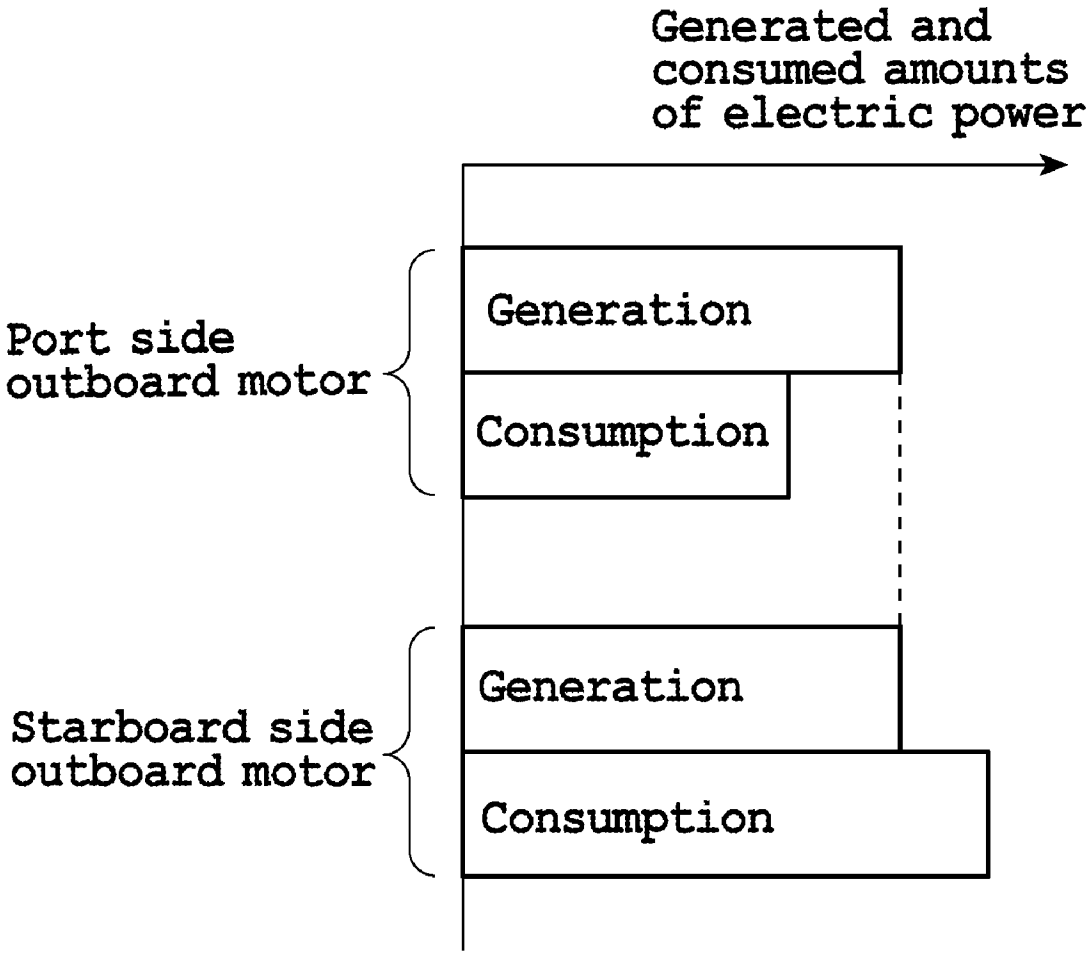
FIG. 11A PRIOR ART
Figure 11B:
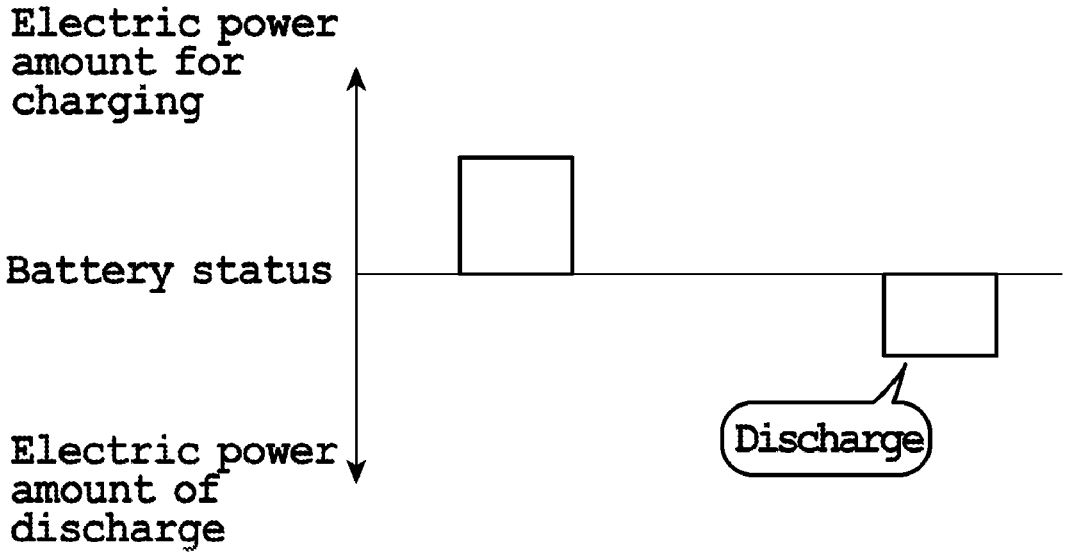
FIG. 11B PRIOR ART

FIG. 9 shows a fourth preferred embodiment of the present invention.

Comparing the fourth preferred embodiment with the third preferred embodiment, a single generator 42 preferably is provided for each outboard motor 12 in the third preferred embodiment. However, in the fourth preferred embodiment, two generators 42 preferably are provided for each outboard motor 12. One of the generators 42 is connected to a single main battery 43, and the other generator 42 is connected to the sub-battery 44.

Thereby, one of the generators 42 provided for an arbitrary outboard motor 12 is used for charging the main battery 43 of this outboard motor 12 and for supplying electric power to the rudder deflecting system 16 of this outboard motor 12, and is not used for supplying electric power to the rudder deflecting system 16 of the other outboard motor 12. Therefore, the amount of electric power for charging the main batteries 43 can be secured.

The other generator 42 supplies electric power to the rudder deflecting system 16 of the other outboard motor 12. The other generator 42 also charges the main battery 43 of the other outboard motor 12.

Other constructions and actions are similar to the third preferred embodiment, and descriptions will not be made.

In each of the above preferred embodiments, a watercraft is provided with two outboard motors. However, the present invention maybe applied to a watercraft with three, four, or more outboard motors. In such a case, combinations of generators, rudder deflecting systems, main batteries, and the like may be simply added. An outboard motor is an example of a watercraft propulsion unit in each of the above preferred embodiments. However, the present invention can be applied to inboard/outboard motors.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A watercraft comprising:

a plurality of watercraft propulsion units;

at least one generator provided for each of the plurality of watercraft propulsion units;

a rudder deflecting system arranged in each of the plurality of watercraft propulsion units, each rudder deflecting system being driven by an electric motor, and the plurality of watercraft propulsion units being arranged to be turned by operation of the rudder deflecting systems thereby steering the watercraft;

a main battery arranged in each of the plurality of the watercraft propulsion units and electrically connected thereto; and a sub-battery connected to the plurality of the watercraft propulsion units; wherein the at least one generator for each watercraft propulsion unit and the rudder deflecting systems are arranged such that electric power can be supplied from the at least one generator for each watercraft propulsion unit to the rudder deflecting system of another watercraft propulsion unit included among the plurality of the watercraft propulsion units; and when an electric power consumption of the rudder deflecting system of a first watercraft propulsion unit is larger than an electric power consumption of the rudder deflecting system of a second watercraft propulsion unit, a portion of the electric power generated by the generator of the second watercraft propulsion unit is supplied to the rudder deflecting system of the first watercraft propulsion unit in addition to the electric power generated by the generator of the first watercraft propulsion unit being supplied to the rudder deflecting system of the first watercraft propulsion unit.

2. The watercraft according to claim 1, wherein the main battery is arranged to supply electric power to the rudder deflecting system of the first watercraft propulsion unit and arranged not to supply electric power to the rudder deflecting system of the second watercraft propulsion unit.

3. The watercraft according to claim 1, wherein electric power is supplied from the at least one generator of the first watercraft propulsion unit to the main battery of the second watercraft propulsion unit.

4. The watercraft according to claim 2, wherein electric power is supplied from the sub-battery to each of the main batteries.

5. The watercraft according to claim 2, wherein a plurality of generators are provided for each of the watercraft propulsion units, a first of the plurality of generators is connected to the main battery, and at least a second of the plurality of generators is connected to the rudder deflecting systems of the other watercraft propulsion units.

6. The watercraft according to claim 3, wherein a plurality of generators are provided for each of the watercraft propulsion units, a first one of the plurality of generators is connected to the main battery, and at least a second of the plurality of generators is connected the rudder deflecting systems of the other watercraft propulsion units.

* * * * *